US011685161B2

(12) United States Patent
Lee et al.

(10) Patent No.: US 11,685,161 B2
(45) Date of Patent: Jun. 27, 2023

(54) INK TANK FOR LIQUID CHEMICAL DISCHARGING APPARATUS AND LIQUID CHEMICAL DISCHARGING APPARATUS INCLUDING THE SAME

(71) Applicant: SEMES Co. Ltd., Cheonan-si (KR)

(72) Inventors: Donghwa Lee, Cheonan-si (KR); Daigeon Yoon, Seoul (KR); Jaeyong Choi, Seoul (KR); Sanguk Son, Suwon-si (KR); Kihoon Choi, Hwaseong-si (KR); Daesung Kim, Cheonan-si (KR)

(73) Assignee: SEMES Co. Ltd., Cheonan-si (KR)

( * ) Notice: Subject to any disclaimer, the term of this patent is extended or adjusted under 35 U.S.C. 154(b) by 455 days.

(21) Appl. No.: 16/920,193

(22) Filed: Jul. 2, 2020

(65) Prior Publication Data

US 2021/0001634 A1 Jan. 7, 2021

(30) Foreign Application Priority Data

Jul. 3, 2019 (KR) ..... 10-2019-0080327

(51) Int. Cl.
*B41J 2/175* (2006.01)
*B41J 19/08* (2006.01)

(52) U.S. Cl.
CPC ..... *B41J 2/17513* (2013.01); *B41J 2/17503* (2013.01); *B41J 2/17553* (2013.01); *B41J 2/17556* (2013.01); *B41J 19/08* (2013.01)

(58) Field of Classification Search
CPC ..... B41J 2/17513; B41J 2/17503; B41J 2/17553; B41J 2/17556; B41J 19/08; B41J 2/17523; B41J 2/17563
See application file for complete search history.

(56) References Cited

U.S. PATENT DOCUMENTS

2005/0116997 A1* 6/2005 Katoh ..... B41J 2/17503 347/84
2020/0180322 A1* 6/2020 Lee ..... B41J 2/18

FOREIGN PATENT DOCUMENTS

KR 2003069599 A * 8/2003 ..... B41J 2/175
KR 10-2004-0035408 A 4/2004
KR 10-2014-0003986 A 1/2014
KR 2014003986 A * 1/2014
KR 10-2018-0014335 A 2/2018

* cited by examiner

*Primary Examiner* — Sharon Polk
(74) *Attorney, Agent, or Firm* — NSIP Law

(57) ABSTRACT

An ink tank for a liquid chemical discharging apparatus configured to prevent equipment failure and improve durability by preventing scattering and backflow of a liquid chemical is described. The ink tank for a liquid chemical discharging apparatus includes: a liquid chemical receiving portion in which a liquid chemical is stored; a liquid chemical discharge port configured to supply the liquid chemical to an inkjet head; a pressure control port configured to control pressure of the liquid chemical receiving portion; and a partition wall provided in the liquid chemical receiving portion and configured to partition the liquid chemical receiving portion.

19 Claims, 3 Drawing Sheets

[FIG. 1]
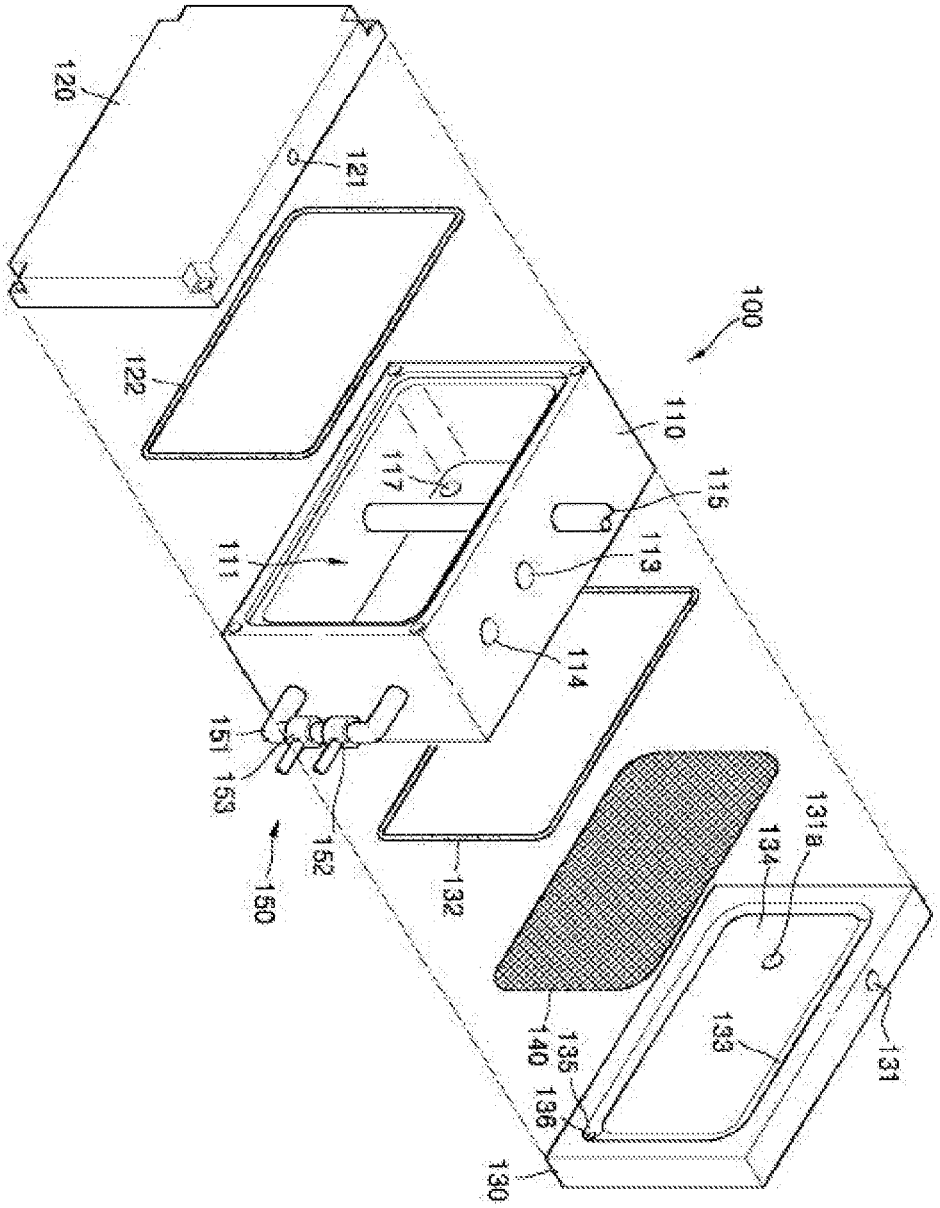
--Background Art --

[FIG. 2]
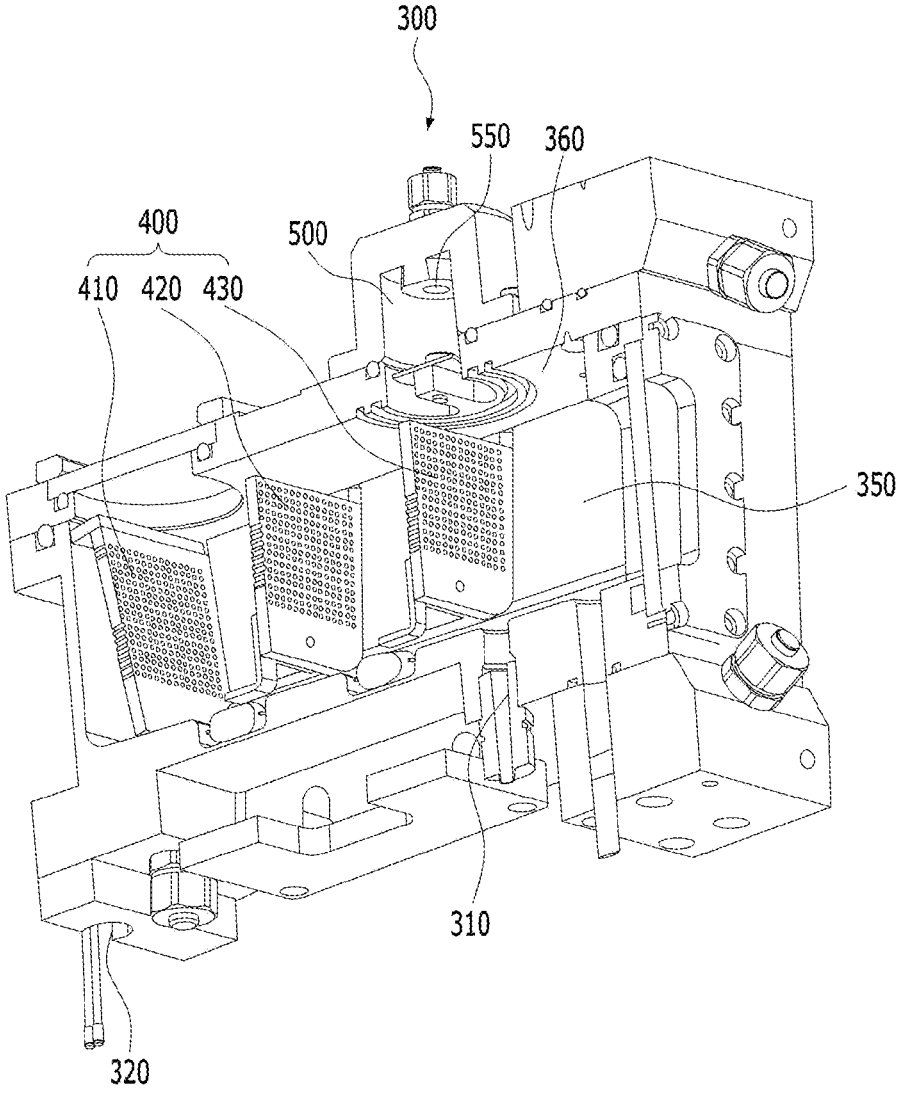

[FIG. 3]
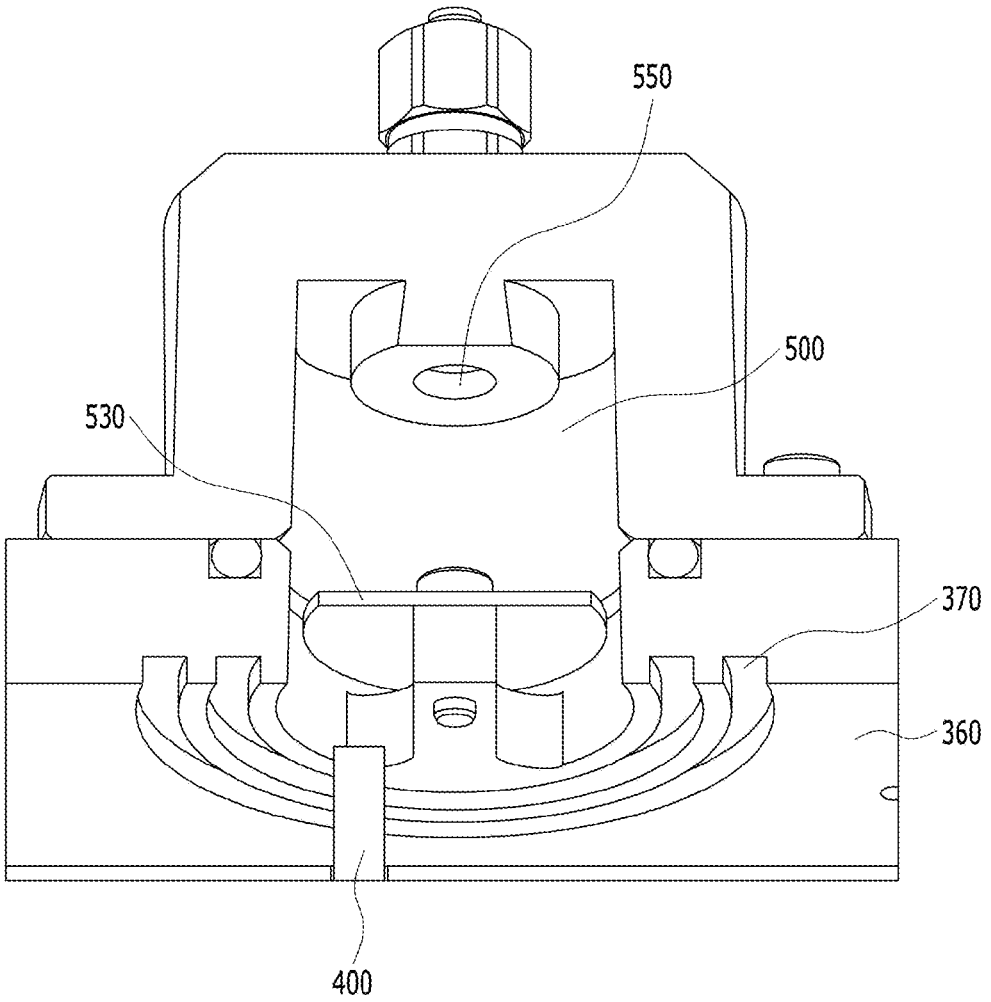
[FIG. 4]
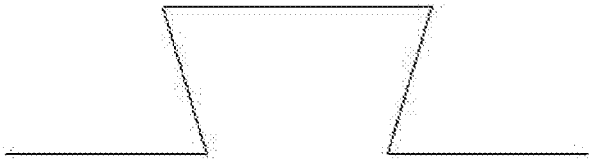

INK TANK FOR LIQUID CHEMICAL DISCHARGING APPARATUS AND LIQUID CHEMICAL DISCHARGING APPARATUS INCLUDING THE SAME

CROSS-REFERENCE TO RELATED APPLICATION

This application claims the benefit under 35 U.S.C. 119(a) of Korean Patent Application No. 10-2019-0080327 filed on Jul. 3, 2019, in the Korean Intellectual Property Office, the entire disclosure of which is incorporated herein by reference for all purposes.

BACKGROUND

1. Field

The present disclosure relates to an ink tank for a liquid chemical discharging apparatus and a liquid chemical discharging apparatus including the same, and specifically, to an ink tank for a liquid chemical discharging apparatus and an liquid chemical discharging apparatus including the same capable of preventing equipment failure and improving durability by preventing scattering and backflow of a liquid chemical.

2. Description of the Related Art

In order to manufacture a display device such as an LCD, inkjet equipment is often used to form an alignment film or discharge droplets when applying UV ink, or applying a color filter on a substrate.

Such inkjet equipment is equipped with a head for discharging droplets, an ink tank for supplying a liquid chemical such as a liquid crystal to the head, wherein the ink tank is usually integrated with the head and moves together as the head moves.

According to Korean Patent Publication No. 10-2004-0035408 illustrated in FIG. 1, an ink tank 100 according to the related art has a discharge pipe 115 capable of exchanging ink with a main body 100, first and second through holes 113 and 114 to which a pressurization line and a depressurization line may be connected, and a membrane 140 formed between a main body 110 and a rear head 130 to prevent the ink from passing.

The pressurization line and the depressurization line connected to the first and second through holes 113 and 114 apply positive (+) pressure or negative (−) pressure to the inside of the main body to maintain a meniscus shape of the ink of the head.

Such an ink tank moves integrally with the head, and as the acceleration is issued, the liquid chemical flows along the inner wall surface of the ink tank while the liquid chemical therein sloshes to cause a problem of contaminating the components.

In addition, when the negative (−) pressure is generated by the depressurization line, there is a problem in that the ink flows backward and is introduced to cause the failure of the equipment.

SUMMARY

In order to solve the problems, an object of the present disclosure is to prevent contamination due to a liquid chemical by suppressing the liquid chemical from sloshing and improve durability of an ink tank by preventing the liquid chemical from flowing backward.

In order to solve the problems, the present disclosure provides an ink tank for a liquid chemical discharging apparatus including: a liquid chemical receiving portion in which a liquid chemical is stored; a liquid chemical discharge port supplying the liquid chemical to an inkjet head; a pressure control port for controlling pressure of the liquid chemical receiving portion; and a partition wall which is provided in the liquid chemical receiving portion to partition the liquid chemical receiving portion.

A plurality of scattering prevention holes may be formed in the partition wall to prevent the scattering of the liquid chemical.

A scattering prevention hole located in the upper direction among the plurality of scattering prevention holes is formed larger than the size of the scattering prevention hole located in the lower direction among the plurality of scattering prevention holes.

The partition wall may include a first partition; and the liquid chemical is injected into the liquid chemical receiving portion through a plurality of scattering prevention holes which is formed in the first partition wall.

The partition wall may include a second partition wall and a third partition wall which block both sides of the liquid chemical receiving portion, The liquid chemical is allowed to pass to the adjacent partition through the scattering prevention holes to prevent the liquid chemical from spurting high when the sloshing of the liquid chemical is severe, A buffer portion is formed between the pressure control port and one side surface of the liquid chemical receiving portion to prevent the backflow of the liquid chemical.

A backflow prevention groove is formed on one side surface of the liquid chemical receiving portion adjacent to the buffer portion to prevent the backflow of the liquid chemical.

A guide filter is provided in the buffer portion to separate and pass liquid and gas components.

The guide filter is configured to pass gas such as $N_2$ without passing a liquid chemical.

In order to solve the problems, the present disclosure provides a liquid chemical discharging apparatus including: a head discharging droplets; and an ink tank for supplying a liquid chemical to the head, wherein the ink tank comprises a liquid chemical receiving portion in which a liquid chemical is stored; a liquid chemical discharge port supplying the liquid chemical to an inkjet head; a pressure control port for controlling pressure of the liquid chemical receiving portion; and a partition wall which is provided in the liquid chemical receiving portion to partition the liquid chemical receiving portion.

A plurality of scattering prevention holes may be formed in the partition wall to prevent the scattering of the liquid chemical.

A scattering prevention hole located in the upper direction among the plurality of scattering prevention holes may be formed larger than the size of the scattering prevention hole located in the lower direction among the plurality of scattering prevention holes.

The partition wall may include a first partition; and the liquid chemical may be injected into the liquid chemical receiving portion through a plurality of scattering prevention holes which is formed in the first partition wall.

The partition wall may include a second partition wall and a third partition wall which block both sides of the liquid chemical receiving portion, The liquid chemical may be allowed to pass to the adjacent partition through the scattering prevention holes to prevent the liquid chemical from spurting high when the sloshing of the liquid chemical is severe, A buffer portion may be formed between the pressure control port and one side surface of the liquid chemical receiving portion to prevent the backflow of the liquid chemical.

A backflow prevention groove may be formed on one side surface of the liquid chemical receiving portion adjacent to the buffer portion to prevent the backflow of the liquid chemical.

A guide filter may be provided in the buffer portion to separate and transmit liquid and gas components.

According to the present disclosure, it is possible to prevent contamination due to a liquid chemical by suppressing the liquid chemical from sloshing and improve durability of an ink tank by preventing the liquid chemical contained therein from flowing backward out of the ink tank.

BRIEF DESCRIPTION OF THE DRAWINGS

FIG. 1 illustrates an exploded perspective view illustrating a configuration of an ink tank according to the related art;

FIG. 2 illustrates a cutout perspective view illustrating a configuration of an ink tank according to one or more embodiment of the present disclosure;

FIG. 3 illustrates a structural view illustrating a structure of a buffer portion in FIG. 2 according to one or more embodiment of the present disclosure; and FIG. 4 illustrates a cross-sectional view illustrating another example of a backflow prevention groove in FIG. 3 according to one or more embodiment of the present disclosure.

DETAILED DESCRIPTION

Configurations and functions of embodiments of the present disclosure will be described in detail with reference to the accompanying drawings. In the present embodiment, a liquid chemical may be used in the same meaning as ink, and refers to a material to be discharged through an inkjet device, such as a liquid crystal and a polymer light emitting material.

An ink tank according to one or more embodiments of the present disclosure may be included in an inkjet device capable of manufacturing a liquid crystal display (LCD), a polymer organic electroluminescent device, and the like. The inkjet device according to the present disclosure includes a head discharging droplets, and an ink tank for supplying the liquid chemical such as a liquid crystal to the head. A liquid chemical discharging apparatus according to the present disclosure includes a head discharging droplets and an ink tank for supplying a liquid chemical to the head. Referring to FIG. 2, an ink tank 300 according to the present disclosure includes a liquid chemical receiving portion 350, a liquid chemical discharge port 310, a liquid chemical injection port 320, a buffer portion 500, a pressure control port 550, and a partition wall 400.

The liquid chemical receiving portion 350 is formed as an empty space in a housing forming the appearance of the ink tank, and the liquid chemical receiving portion 350 is formed by surrounding an upper surface, a lower surface, and four side surfaces.

The liquid chemical may be injected into the ink tank through the liquid chemical injection port 320, and the liquid chemical is injected and stored into the liquid chemical receiving portion 350 through the first partition wall 410.

The liquid chemical receiving portion 350 has a plurality of partition walls 410, 420, and 430, and the liquid chemical receiving portion is partitioned by the plurality of partition walls.

The second partition wall 420 and the third partition wall 430 block both sides of the liquid chemical receiving portion, and are formed at predetermined intervals with the upper surface and the lower surface thereof so that the liquid chemical may flow downwards of the second partition wall and the third partition wall.

As such, since a plurality of partition walls are formed in the liquid chemical receiving portion 350, a space between the partition walls is smaller, so that the sloshing of the liquid chemical is reduced when the ink tank performs an acceleration movement.

A plurality of scattering prevention holes are formed in each of the partition walls 410, 420, and 430 to prevent scattering of the liquid chemical. The scattering prevention hole is formed of fine holes, and the scattering prevention hole is formed so that the space between the partition walls is not completely blocked. As a result, when the sloshing of the liquid chemical is severe, the scattering prevention hole allows the liquid chemical to pass to the adjacent partition through the scattering prevention hole to prevent the liquid chemical from spurting high.

The size of the scattering prevention hole may be formed to increase as it goes upward. That is, the scattering prevention hole located in the upper direction among the plurality of scattering prevention holes is formed larger than the size of the scattering prevention hole located in the lower direction among the plurality of scattering prevention holes. Such a structure prevents the size of the sloshing from increasing by increasing the partition force when the sloshing of the liquid chemical is small and efficiently prevents the liquid chemical from reaching the upper surface of the liquid chemical receiving portion by allowing the liquid chemical to pass through the partition walls and pass to the adjacent partition as sloshing of the liquid chemical is increased.

The liquid chemical injection port 320 is formed on the outside of the first partition wall 410, and the liquid chemical injected from the outside through the liquid chemical injection port 320 passes through the first partition wall 410 to be injected into the liquid chemical receiving portion 350. The first partition wall 410 is configured such that not only both sides but also the lower surface of the liquid chemical receiving portion 350 are blocked and thus the liquid chemical is injected only through the scattering prevention hole, and a filter (not illustrated) is provided to remove foreign substances from the outside.

The liquid chemical supplied from the liquid chemical receiving portion 350 to the inkjet head is supplied through the liquid chemical discharge port 310. The liquid chemical discharge port 310 is formed on the lower surface of the outside thereof from the first partition wall 410 through the third partition wall 430, which is the last partition wall.

In addition, the pressure control port 550 for controlling the pressure in the liquid chemical receiving portion 350 is formed on the upper portion of the liquid chemical discharge port 310.

A pressure regulating device such as a pump is connected to the pressure control port 550 to control the pressure in the liquid chemical receiving portion 350.

That is, the pressure regulating device controls the pressure in the liquid chemical receiving portion by blowing pressure gas, such as $N_2$, to make positive (+) pressure or removing the pressure gas to make negative (−) pressure.

Specifically, when the positive (+) pressure is made by the pressure regulating device, the connected head is pressurized and the liquid chemical is discharged on the substrate by a piezoelectric element provided in the head. On the contrary, when the negative (−) pressure is made by the pressure regulating device, the negative pressure is maintained in the head and the shape of the liquid chemical at the tip of the nozzle is maintained to a meniscus shape.

In the present embodiment, the buffer portion 500 preventing the backflow of the liquid chemical is formed between one side surface of the liquid chemical receiving portion 350 and the pressure control port 550.

The structure of the buffer portion 500 will be described with reference to FIG. 3.

The buffer portion 500 is formed between an upper surface 360 of the liquid chemical receiving portion 350 and the pressure control port 550, and the pressure control port 550 is spaced apart from the liquid chemical receiving portion 350 at a predetermined distance by the buffer portion 500 to prevent the liquid chemical from being in direct contact with the pressure control port 550 even if some of the liquid chemical sloshes or backflows.

Even in the presence of the buffer layer, when the negative (−) pressure is made by the pressure regulating device, the liquid chemical may be sucked into the pressure control port 550. To prevent this, the buffer portion 500 has a guide filter 530.

The guide filter 530 is provided in a disk shape and is installed in a structure configured to block a passage from the liquid chemical receiving portion to the pressure control port. The guide filter 530 serves to separate and pass liquid and gas components, and specifically, The guide filter 530 is configured to pass gas such as $N_2$ without passing a liquid chemical.

Therefore, the guide filter 530 effectively prevents the liquid chemical contained in the liquid chemical receiving portion from flowing back while the gas for pressure control is not disturbed.

Meanwhile, a plurality of backflow prevention grooves 370 are formed around the buffer portion 500. That is, the backflow prevention grooves are formed in a shape surrounding the buffer portion on the upper surface of the liquid chemical receiving portion 350 around the buffer portion.

The backflow prevention grooves 370 prevent the liquid chemical in contact with the inner wall or upper surface of the liquid chemical receiving portion 350 from moving toward the pressure control port 550. Specifically, the liquid chemical droplets stained on the upper surface move toward the buffer portion 500 along the upper surface as the negative (−) pressure is made by the pressure control device. When the droplets moved as such are introduced to the backflow prevention grooves 370, the droplets are collected into the groove formed upward by the surface tension and capillary force, and over time, the droplets are collected again and fall down by gravity.

In an example, a plurality of the backflow prevention grooves 370 are formed according to the distance from the buffer portion to block the liquid chemical to approaching the buffer portion in advance.

A cross-sectional shape of the backflow prevention groove 370 may have an inclined surface such that the cross-sectional area becomes wider toward a depth direction (upward direction) as illustrated in FIG. 4, and such as cross-sectional shape increases the surface area at the same depth to confine droplets.

As described above, the present disclosure has been described with reference to the exemplary embodiments. However, it will be appreciated by those skilled in the art that various modifications and changes of the present disclosure can be made without departing from the spirit and the scope of the present disclosure which are disclosed in the appended claims.

The invention claimed is:

1. An ink tank for a liquid chemical discharging apparatus comprising:

a liquid chemical receiving portion in which a liquid chemical is stored;

a liquid chemical discharge port configured to supply the liquid chemical to an inkjet head;

a pressure control port configured to control pressure of the liquid chemical receiving portion; and a plurality of partition walls provided in the liquid chemical receiving portion and configured to partition the liquid chemical receiving portion, each partition wall comprising a plurality of scattering prevention holes, wherein a scattering prevention hole located in an upper direction among the plurality of scattering prevention holes has a size larger than that of the scattering prevention hole located in a lower direction among the plurality of scattering prevention holes.

2. The ink tank for the liquid chemical discharging apparatus of claim 1, wherein the plurality of scattering prevention holes are configured to prevent the scattering of the liquid chemical.

3. The ink tank for the liquid chemical discharging apparatus of claim 1, wherein each of the plurality of scattering prevention holes increases in size toward an upper part of each partition wall.

4. The ink tank for the liquid chemical discharging apparatus of claim 1, wherein the plurality of partition walls include a first partition; and wherein the liquid chemical is injected into the liquid chemical receiving portion through the plurality of scattering prevention holes formed in the first partition wall.

5. The ink tank for the liquid chemical discharging apparatus of claim 4, wherein the plurality of partition walls include a second partition wall and a third partition wall configured to block both sides of the liquid chemical receiving portion.

6. The ink tank for the liquid chemical discharging apparatus of claim 1, wherein the plurality of scattering prevention holes allow the liquid chemical to pass through the plurality of scattering prevention holes to an adjacent partition to prevent the liquid chemical from spurting high when sloshing of the liquid chemical is severe.

7. The ink tank for the liquid chemical discharging apparatus of claim 1, further comprising:

a buffer portion formed between the pressure control port and one side surface of the liquid chemical receiving portion and configured to prevent a backflow of the liquid chemical.

8. The ink tank for the liquid chemical discharging apparatus of claim 7, further comprising:

a backflow prevention groove formed on one side surface of the liquid chemical receiving portion adjacent to the buffer portion and configured to prevent the backflow of the liquid chemical.

9. The ink tank for the liquid chemical discharging apparatus of claim 7, further comprising:

a guide filter provided in the buffer portion and configured to separate and pass liquid and gas components.

10. The ink tank for the liquid chemical discharging apparatus of claim 9, wherein the guide filter is configured to pass gas without passing the liquid chemical.

11. A liquid chemical discharging apparatus comprising:

a head discharging droplets; and an ink tank configured to supply a liquid chemical to the head, wherein the ink tank comprises:

a liquid chemical receiving portion in which the liquid chemical is stored;

a liquid chemical discharge port configured to supply the liquid chemical to an inkjet head;

a pressure control port configured to control pressure of the liquid chemical receiving portion; and a plurality of partition walls provided in the liquid chemical receiving portion and configured to partition the liquid chemical receiving portion, each partition wall comprising a plurality of scattering prevention holes, and wherein the plurality of scattering prevention holes allow the liquid chemical to pass through the plurality of scattering prevention holes to an adjacent partition to prevent the liquid chemical from spurting high when sloshing of the liquid chemical is severe.

12. The liquid chemical discharging apparatus of claim 11, wherein the plurality of scattering prevention holes are formed in each of the plurality of partition walls to prevent scattering of the liquid chemical.

13. The liquid chemical discharging apparatus of claim 11, wherein a scattering prevention hole located in an upper direction among the plurality of scattering prevention holes has a size larger than that of the scattering prevention hole located in a lower direction among the plurality of scattering prevention holes.

14. The liquid chemical discharging apparatus of claim 11, wherein the plurality of partition walls include a first partition; and wherein the liquid chemical is injected into the liquid chemical receiving portion through the plurality of scattering prevention holes formed in the first partition wall.

15. The liquid chemical discharging apparatus of claim 11, wherein the plurality of partition walls include a second partition wall and a third partition wall configured to block both sides of the liquid chemical receiving portion.

16. The liquid chemical discharging apparatus of claim 11, further comprising:

a buffer portion formed between the pressure control port and one side surface of the liquid chemical receiving portion and configured to prevent a backflow of the liquid chemical.

17. The liquid chemical discharging apparatus of claim 16, further comprising:

a backflow prevention groove formed on one side surface of the liquid chemical receiving portion adjacent to the buffer portion and configured to prevent the backflow of the liquid chemical.

18. The liquid chemical discharging apparatus of claim 16, further comprising:

a guide filter provided in the buffer portion and configured to separate and pass liquid and gas components.

19. The liquid chemical discharging apparatus of claim 18, wherein the guide filter is configured to pass gas without passing the liquid chemical.

* * * * *